United States Patent [19]

Zwettler

[11] 4,032,943

[45] June 28, 1977

[54] DENTAL X-RAY FILM PROCESSING SYSTEM

[75] Inventor: Ernest Zwettler, Los Angeles, Calif.

[73] Assignee: Pennwalt Corporation, Philadelphia, Pa.

[22] Filed: June 19, 1975

[21] Appl. No.: 588,562

[52] U.S. Cl. ..... 354/312; 250/468; 250/477; 354/322; 354/335

[51] Int. Cl.[2] ..... G03D 17/00

[58] Field of Search ..... 354/297, 312, 315, 316, 354/319, 320, 321, 322, 333, 335; 134/64 P, 122 P; 250/468, 471, 477, 478

[56] References Cited

UNITED STATES PATENTS

| | | | |
|---|---|---|---|
| 3,435,749 | 4/1969 | Cauwe et al. | 354/319 X |
| 3,532,048 | 10/1970 | Hope et al. | 354/320 X |
| 3,608,467 | 9/1971 | Rouff | 134/122 P |
| 3,712,206 | 1/1973 | Schmidt | 354/322 |
| 3,747,499 | 7/1973 | Foster | 354/322 X |
| 3,882,525 | 5/1975 | Zwettler | 354/316 |

*Primary Examiner*—Fred L. Braun
*Attorney, Agent, or Firm*—Charles N. Quinn

[57] ABSTRACT

A dental x-ray film processor system, including a developer processor and a magazine, for the automatic development of one or a plurality of standard sized dental x-ray films. The films can be of any of the three sizes which are generally designated as standard sizes and sizes can be mixed. The individual films need not be placed in the magazine dispenser in a contiguous manner; they can be placed in the dispenser in an intermittent fashion. The x-ray film processor is disposed to accept films from the magazine, one at a time, and to sequentially process the films through a developer bath, a fixer bath, a rinse bath and to dry the individual films before dispensing them one-by-one.

6 Claims, 17 Drawing Figures

DENTAL X-RAY FILM PROCESSING SYSTEM

BACKGROUND OF THE INVENTION

1. FIELD OF THE INVENTION

The present invention is in the field of film developing apparatus and more particularly in the field of dental x-ray film developing apparatus. Specifically, the present invention relates to an apparatus for storing, dispensing and developing one or more exposed dental x-ray films of the standard size, where the developing process is performed automatically and the user need only place a dispenser magazine, filled with the dental x-ray films, in position in disposition with the developing apparatus and then actuate the apparatus. The apparatus is specifically designed to be quite compact so as to occupy a minimum of space in the dentist's office.

2. Description of the Prior Art

Processors for the processing of film and film-like materials are well known in various arts. In the dental arts, until recently, dentists were forced to maintain darkroom-type facilities in their offices so that they could develop x-ray films for diagnosis of their patient's dental problems while the patient was in the office. Such darkroom facilities occupy substantial space and thus contribute to the dentist's overhead expense. Accordingly, there is and has been a need for a compact dental x-ray film processing apparatus which operates substantially automatically, thus freeing the dentist and his allied personnel for more important tasks.

One response to this problem is the apparatus disclosed in U.S. Pat. No. 3,857,040, issued to the present inventor and to Goebels. The apparatus disclosed in U.S. Pat. No. 3,857,040 automatically processes a single piece of large, non-standard size dental x-ray film. However, that apparatus is not suitable for the continuous automatic processing of a plurality of dental x-ray films without substantially continuous attendance by the dentist or one of his employees. Specifically, that apparatus requires that the x-ray film dispenser cassette be changed every time it is desired to process a separate x-ray film. Furthermore, that apparatus is not suitably adapted for processing x-ray films of the standard sizes. Accordingly, the need for automatically processing a plurality of standard size x-ray films has not been filled by the devices available heretofore.

Normally when a patient is in the dentist's office, the dentist will desire a plurality of x-ray pictures to aid the dentist in his evaluation of his patient's dental health. As a minimum, the dentist will usually require four x-rays, one each of the upper and lower jaw on either side, and, depending on the condition under investigation, many more x-rays may be required. It is most desirable to be able to automatically process such a plurality of x-ray films in a minimum amount of time with a minimum of attendance from the dentist or his employees. This is not possible with the device shown in U.S. Pat. No. 3,857,040, because a new x-ray film cassette must be inserted by hand into the film processor every time it is desired to process another dental x-ray picture.

A further disadvantage of the apparatus shown in U.S. Pat. No. 3,857,040 is that the apparatus shown cannot process dental x-ray films of the standard size.

Due to a plurality of factors, including convenience, the dominance of Kodak in the dental x-ray film industry as a supplier of the dental x-ray film, and the choice of dental x-ray equipment apparatus manufacturers, three sizes of x-ray film have become more or less standard in the industry, with these three sizes of film comprising approximately 95% of the dental x-ray film utilized in the United States. These three sizes of film are Kodak size number 0, which is 7/8 of an inch by 1 and 3/8 inches, Kodak number 2, which is 1 and 1/4 inches by 1 and 5/8 inches and Kodak number 3 which is 1 and 1/16 inches by 2 and 1/8 inches. The present apparatus is designed to process automatically films of any of these three sizes. Additionally, overseas, another film size is quite common that being the size of 3.1 centimeters by 4.1 centimeters which is the same as 1.22 inches by 1.614 inches. The present apparatus is also suitably adapted to handle this standard size film. No such auotmatic film processing system, which is adapted to handle these standard size films and process a plurality of such standard size films is available nor is known in the art.

SUMMARY OF THE INVENTION

Heretofore, it has not been known to construct an automatic dental x-ray film processing apparatus to dispense and automatically process a plurality of standard size dental x-ray films. The present invention provides an automatic dental x-ray film processing apparatus which overcomes the aforementioned disadvantages and difficulties which are present in the prior art.

In accordance with the foregoing, it is a principal object of the present invention to provide an automatic dental x-ray film processing apparatus which can process the different sizes of dental x-ray films which have come to be designated in the industry generally as standard size x-ray films.

It is a further object of the present invention to provide an automatic dental x-ray film processing apparatus which can process together the different sizes of dental x-ray films which have come to be designated in the industry generally as standard size x-ray films.

It is a further object of the present invention to provide an apparatus for automatically sequentially processing a plurality of standard size dental x-ray films which will automatically process the films without an attendant needing to be present to change or insert the films individually.

It is a further object of the present invention to provide an automatic dental x-ray film processing system having as a part thereof a magazine dispenser for dispensing one or a plurality of films into a developer apparatus.

It is a further object of the present invention to provide an apparatus for automatically sequentially processing a plurality of standard size dental x-ray films without a human hand touching the x-ray films once they are placed in a dispenser magazine.

It is a further object of the present invention to provide an apparatus for automatically, sequentially processing a plurality of standard size dental x-ray films wherein the apparatus has as a part thereof a magazine which automatically sequentially dispenses the exposed x-ray films of standard size into a developer apparatus.

It is a further object of the present invention to provide an automatic dental x-ray film processing apparatus which accomplishes the above objects and which further provides for continuous mixing of the developer fluid, the fixer fluid and the rinse water fluid required for the processing.

It is a further object of the present invention to provide an apparatus which accomplishes the aforementioned objects and which further processes and dries the dental x-ray films once the films are introduced into the apparatus before the films are released therefrom.

It is a further object of the present invention to provide an apparatus for continuous, sequential automatic processing of a plurality of dental x-ray films wherein a positive drive is provided for each of the dental x-ray films once they enter the processing apparatus until they exit therefrom.

It is a further object of the present invention to provide a magazine dispenser for the automatic dispensing of exposed dental x-ray films in conjunction with said processing apparatus, said magazine having indicia thereon so as to indicate when the magazine dispenser is empty and hence can be removed and further indicating when processing can be stopped.

It is a further object of the present invention to accomplish the above objects and to also provide a method for sequentially processing a plurality of exposed dental x-ray films whereby the films need not be processed at equally spaced intervals one from another.

It is a further object of the present invention to accomplish the above objects while providing a method for sequentially removing a plurality of exposed dental x-ray films from a dispenser magazine for receipt of said films by a developer apparatus wherein said films need not be initially placed in said dispenser magazine in a contiguous spacing.

It is a further object of the present invention to accomplish the above objects while providing a magazine dispenser for sequentially dispensing a plurality of standard size dental x-ray films which is optionally substantially light-tight while standing alone.

These and other objects of the present invention will be apparent to those of ordinary skill in the art from an inspection of the attached drawing figures and from a reading of the following specification and the appended claims.

DESCRIPTION OF THE PREFERRED EMBODIMENTS

Figure 1:
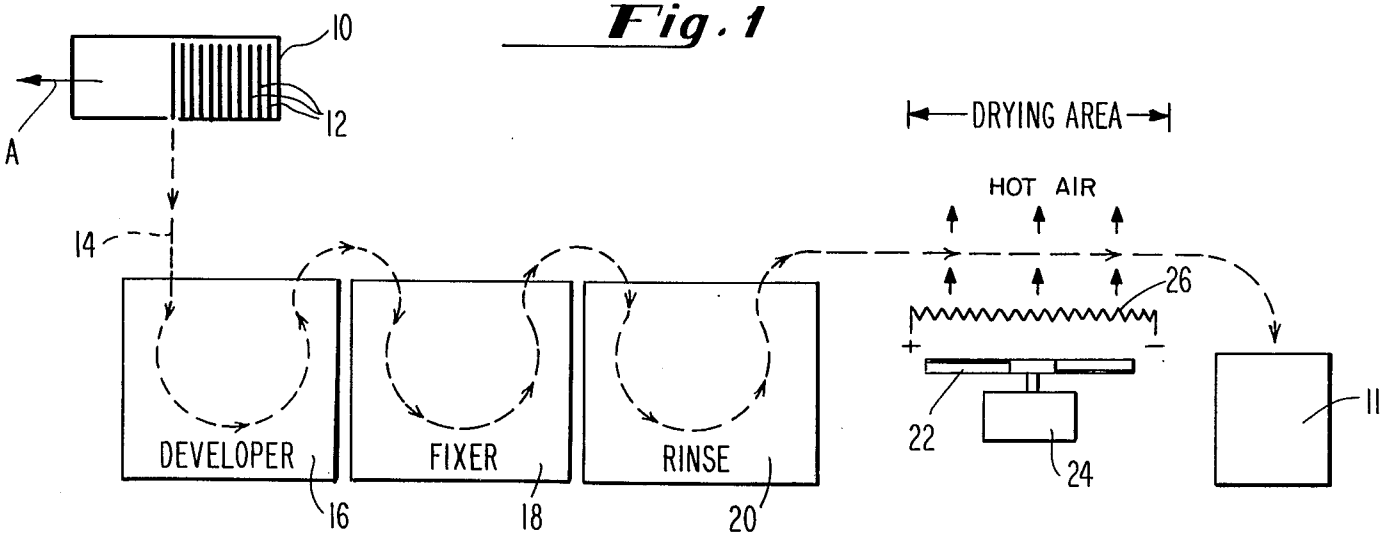
FIG. 1 is a schematic view of the dental x-ray film processing system of the present invention showing a side schematic view of the travel of a plurality of films from a magazine successively through tanks of developer, fixer and rinse and through a drying area of the processing system.

FIG. 1 illustrates in schematic form the operation of the dental x-ray film processing system of the present invention. Initially, a magazine dispenser 10 has contained therein one or a plurality of standard-size dental x-ray films designated as 12. As the magazine is moved by an indexing mechanism, which is not shown, in the direction designated by the arrow "A", the plurality of standard size dental x-ray films contained in the magazine dispenser is dropped from the dispenser, one at a time, in the direction indicated by the arrow on the dotted film path 14. The dotted line 14 indicates in schematic form the path taken by the individual x-ray films as they sequentially pass initially through a tank of developer, designated as 16, then through a tank of fixer, designated as 18, then through a tank of rinse, designated as 20, then through a drying area where they are dried by hot air which is blown over them, before the films are finally dispensed into a container which has been designated as 11. A heating means designated schematically as an electrical wire 26 with an electrical voltage applied thereto is supplied and in conjunction with a fan 22 driven by a fan motor 24, this combination serves to force hot air over the developed films, as they traverse through a drying area, thus drying the films thereby removing all excess water and photographic chemicals from the films. The curvature of the dotted line 14 designating the path of the x-ray films through the developer, fixer and rinse tanks as those films enter and exit from those tanks is drawn substantially to scale and illustrates the actual curvature of the path along which the individual x-ray films travel.

Figure 2:
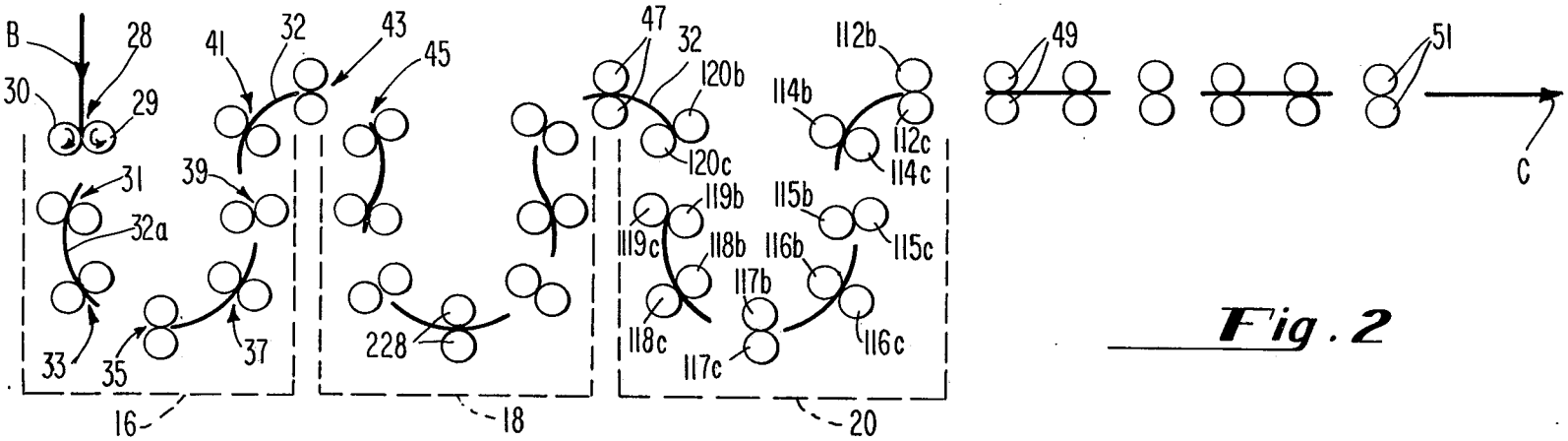
FIG. 2 is a side schematic view showing the path of the dental x-ray films through the pairs of driving rollers which force the dental x-ray films successively through tanks of developer, fixer, rinse and through a drying area.

Referring now to FIG. 2, there is again shown schematically the presence of a plurality of dental x-ray films traveling along through the film guide path or track means and thereby passing sequentially through a tank of developer, a tank of fixer, a tank of rinse and entering the drying area. Each individual film has been depicted by a heavy black line and is indicated typically as 32. The individual films enter the x-ray film processing system from a vertical direction as designated by the arrow "B"and initially are caught between a pair of rollers which are driving rollers designated generally as 28. This pair of rollers comprises two individual rollers 29 and 30 which are initially in tangential contact with one another. The rollers rotate in the direction shown by the arrows on rollers 29 and 30 so as to propel an individual dental x-ray films along its path. The pairs of rollers are so spaced such that a next suceeding pair of rollers grasps the leading edge of an x-ray film before the trailing edge of the film is released by the immediately preceeding pair of rollers. This relationship is illustrated by the pair of rollers 33 and 31 and by the x-ray film which is been designated as **32*a*. It can be seen that the pair of rollers 33 has engaged the leading edge of x-ray film 32*a* while the trailing edge of the dental x-ray film 32*a* is still being driven by a pair of rollers 31. Each one roller of a pair rotates in the direction opposite to the direction of rotation of its mate roller, as illustrated by the arrows on rollers 29 and 30, so as to continuously propel the dental x-ray films along their path. This path until reaching the drying area is defined by a pair of "V" shaped grooves which are in the inside surface of two halves of the drive roller support structure, as will be more fully explained below. These V-shaped grooves are designated generally by the number 154 and are together denominated as forming a guide track means. As can be seen in FIG. 2**, the pairs of rollers are spaced apart such that each dental x-ray film will always be grasped by at least one pair of rollers so that each dental x-ray film can be continuously moved along its path through the developer, fixer and rinse tanks and through the drying area to be eventually ejected by the dental x-ray film processing system.

To aid in the understanding of the present invention, each of the pairs of drive rollers acting to force the dental x-ray films along the path is designated as being associated either with the developer tank, the fixer tank, the rinse tank or the drying area. For instance, roller pairs 28, 31, 33, 35, 37, 39, 41 and 43 have all been designated as drive rollers or drive roller pairs associated with the developer tank. More specifically, drive roller pair 28 is designated as the first pair of rollers associated with the developer tank, drive roller pair 31 has been designated as the second pair of rollers associated with the developer tank and so forth until drive roller pair 43 is reached. This roller pair, although disposed between the developer tank and the fixer tank, has been designated as being associated with the developer tank; specifically roller pair 43 is designated as being the eighth drive roller pair associated with the developer tank. Likewise, roller pair 45 is designated as being the first roller pair associated with the fixer tank and roller pair 47 has been designated as the eighth roller pair associated with the fixer tank. Roller pair **120*b* and 120*c* has been designated as being the first roller pair associated with the rinse tank while roller pair 112*b* and 112*c* has been designated as being the eighth roller pair associated with the rinse tank. Roller pairs which are disposed intermediately between the first and eighth; roller pairs for either the fixer or rinse tanks are designated according to their respective numbers, in sequence, as would be encountered by the dental x-ray films passing through the tanks, in a manner similar to the designation system described above for the developer tank. Roller pair 49 is designated as the first roller pair associated with the drying area while roller pair 51 is designated as the sixth roller pair associated with the drying area. Similarly, roller pairs disposed intermediately between roller pair 49 and roller pair 51** are designated as the second, third, fourth etc. roller pairs associated with the drying area. It is to be understood that each of these rollers rotates and is positively driven so as to propel the individual dental x-ray films along the guide path or track means until the films reach the drying area, whereupon the rollers themselves serve to guide the film, and thus provide for the photographic developing of those films and the drying of those films as they travel through the dental x-ray film processing system.

Figure 3:
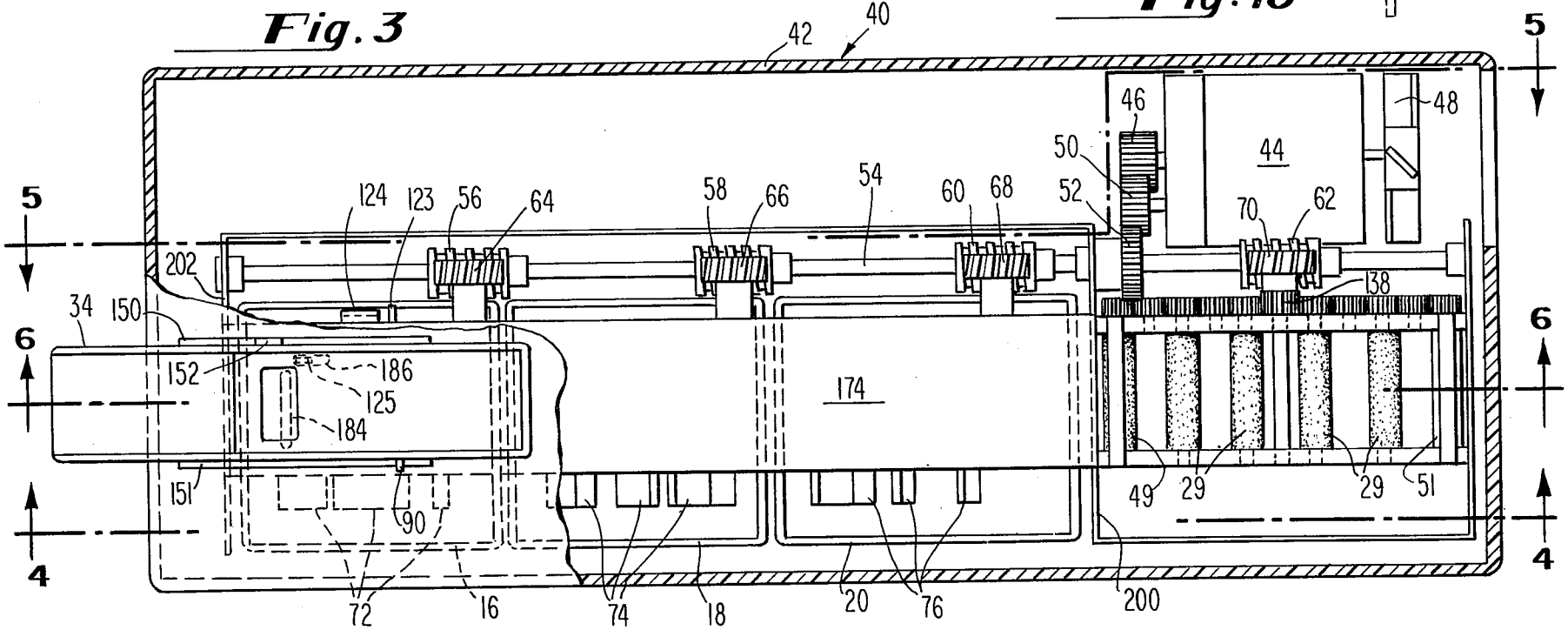
FIG. 3 is a partially broken-away top section view of the dental x-ray film processing system of the present invention.

Referring now to FIG. 3, there is seen the dental x-ray film developing unit designated generally as 40, which has been largely broken away so as to show a portion of the mechanism therein for processing the dental x-ray films. A dental x-ray film magazine dispenser 34 has been shown in place on top of the dental x-ray film developing unit 40 as the dispenser would be disposed during the operation of the dental x-ray film developing and processing system of the present invention. Guide rails 150 and 151 are shown for locating the magazine dispenser 34 on top of the film developing unit 40. The magazine dispenser has a magazine dispenser pin 152 as a position means which is disposed for fitting into a complementally configured notch or position means receiver in the guide rail 150. First and second slots, 184 and 186, in the magazine dispenser are shown in dotted lines since they are located in the bottom surface structure of the magazine dispenser. First slot 184 is the slot through which individual dental x-ray films are dispensed from the magazine dispenser into the x-ray film developing unit 40. Second slot 186 is the slot through which an indexing prong protrudes from the developing unit into the magazine, where the indexing prong provides a means for advancing a portion of the magazine dispenser so as to dispense the individual dental x-ray films, one at a time.

Turning now to the dental x-ray film developing unit designated generally as 40, there is shown a removable housing 42, which is shown generally in section, which comprises the outer housing for the x-ray film developing unit and when in place substantially shields all the equipment inside from dust and light. A drive motor 444 is provided for driving a motor cooling fan 48 and for powering a gear train drive means through which a series of drive rollers means, which propel the x-ray films along a guide path means for development processing, are powered. The drive motor 44 drives the gear train drive means by driving a drive gear 46 which in turn drives an idler gear 50 which in turn drives a driven gear 52. Driven gear 52 is mounted securedly on a power transmission shaft 54 which rotates as driven gear 52 is turned, and transmits torque to first, second, third and fourth worm gears designated as 56, 58, 60 and 62. The first worm gear 56 in turn is in meshed disposition with the developer tank drive gear 64 which serves to drive the gears and consequently the drive rollers which are designated as being associated with the developer tank. Likewise, second worm gear 58 is in meshed disposition with fixer tank drive gear 66 which in turn serves to drive the gears and drive rollers designated as being associated with the fixer tank. Third worm gear 60 is in meshed disposition with the rinse tank drive gear 68 which in turn serves to drive the gears and drive rollers designated as being associated with the rinse tank. Fourth worm gear 62 is in meshed disposition with the drying area drive gear 70 which in turn serves to drive the gears and drive rollers designated as being associated with the drying area. Some of the intermediate drive rollers associated with the drying area are visible and have been designated 29.

Also visible in FIG. 3, in some cases in dotted lines and in other cases in solid lines, are the developer tank 16, the fixer tank 18, and the rinse tank 20. Shown in dotted lines are mixing paddles for the developer liquid 72, while mixing paddles for the fixer liquid 74 and mixing paddles for the rinse liquid 76 are shown in solid lines. The U-frame 174 for securing together the two halves of the drive roller support frame structure is also visible in FIG. 3.

With reference to the gears and the power transmission shaft which have been shown in FIG. 3 and which will be shown in subsequent figures and further discussed, it is to be understood that all of the gears and the power transmission shaft of the present invention may be manufactured of any suitable material and that the gears and the power transmission shaft can be mounted on conventional bushings or bearings in any conventional and suitable manner, many of which are well known in the mechanical arts. Nylon bushings have been used as bearings for the power transmission shaft and the gears in the preferred embodiment of the present invention, however, any suitable bearing material or bearing apparatus may be used in the manufacture of the present invention. It is to be understood that these remarks pertain to all the gears, bearings, bushings, power transmission shafts, roller shafts and similar rotational elements of the present invention.

Figure 4:
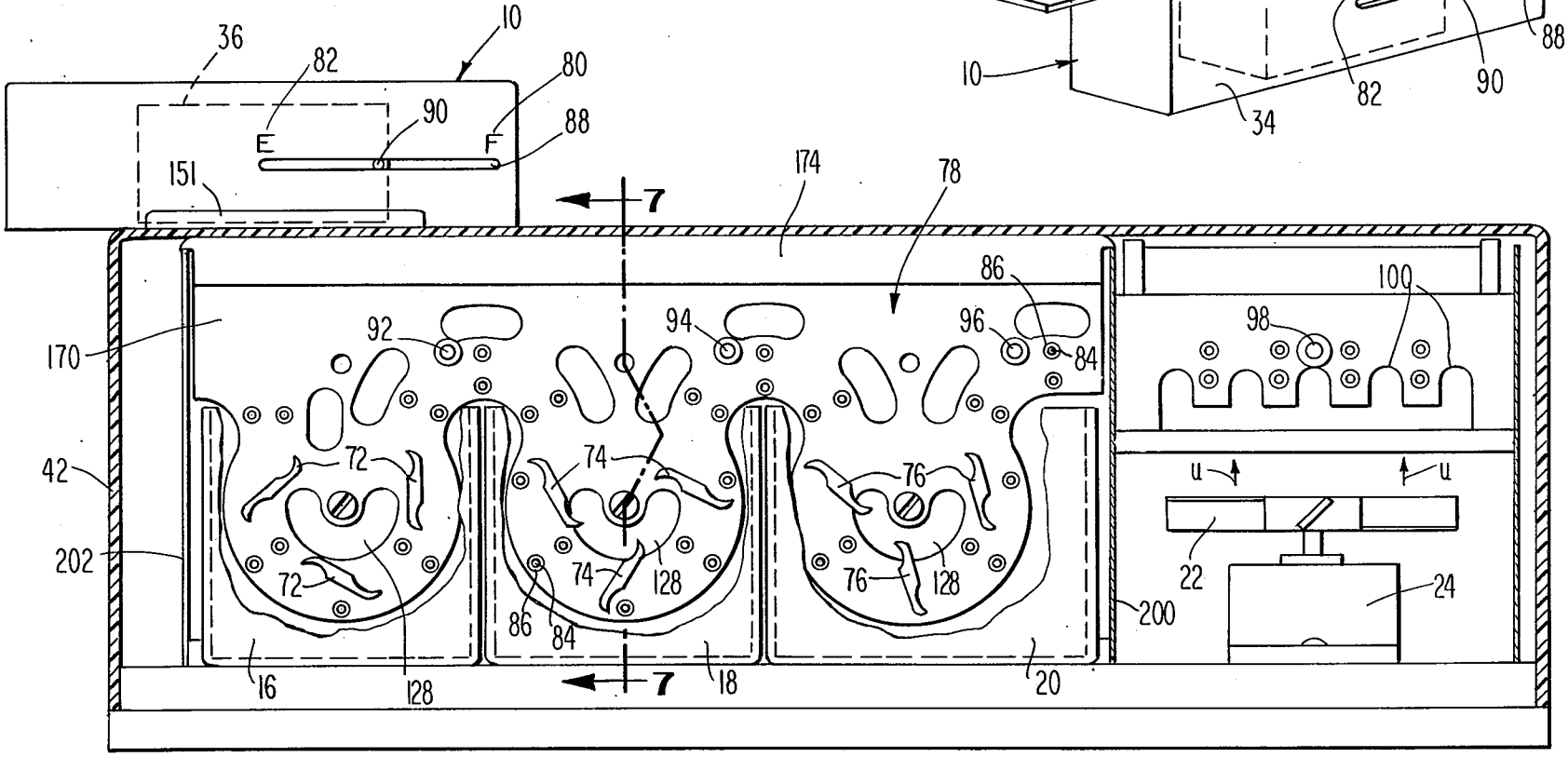
FIG. 4 is a side sectional view taken along the section indicated by the lines and arrows 4—4 of FIG. 3, showing the dental x-ray film processing system of the present invention from the side.

Reference is now made to FIG. 4 which is a sectional view of the dental x-ray file processing system of the present invention with the section taken through the housing 42 and showing the roller drive support frame 78 in substantial detail. In FIG. 4, the magazine dispenser 10 is in place on top of the housing 42 and x-ray film holder 36 is shown in dotted lines within the magazine dispenser. The advancement pin means 90 is visible protruding through the slot means 88 in the magazine dispenser 10. Indicia 80 and 82 on the magazine dispenser act in conjunction with the advancement pin means to indicate to the operator of the processing system whether the film holder within the magazine dispenser is full or empty of dental x-ray films. The magazine dispenser is held in place by two rails for locating the magazine dispenser, one of which is visible as 151.

The three tanks, the developer tank 16, fixer tank 18, and the rinse tank 20 have each been broken away so as to reveal the details of the roller drive support frame designated generally as 78. The roller drive support frame 78 is supported from the top by a U-frame for securing the halves of the roller support frame together with the U-frame designated generally as 174. The roller support frame then comprises two vertically disposed side pieces, one of which is shown as 170; the other corresponding side piece is not visible in FIG. 4. The developer tank drive gear shaft 92, the fixer tank drive gear shaft 94, the rinse tank drive gear shaft 96 and the drying area drive gear shaft 98 are all shown mounted in conventional bushings for rotation therein. The bushings are secured in the roller support frame side piece in any conventional manner many of which are well known in the mechanical arts. Each drive roller shaft 84 is mounted in a suitable drive roller shaft mounting bushing 86 which in turn is secured into the side piece of the roller support frame 170 in conventional fashion. Not all the drive roller shafts and the drive roller shaft mounting bushings visible in FIG. 4 have been given numbers in order to aid the clarity of the drawings. The side piece of the roller support frame 170 has holes therein designated generally as 128 to allow circulation, within the respective tanks, of the developer, fixer and rinse liquids. Paddle means are provided, secured to chosen ones of the roller drive shafts 84, for respectively mixing the developer fluid, the fixer fluid and the rinse fluid in the respective tanks. These paddle means are shown as developer fluid mixing paddles 72, fixer fluid mixing paddles 74 and rinse fluid mixing paddles 76. It is to be understood that each of these paddle means rotates as the drive roller shaft to which it is secured rotates, due to the positive gear drive of each drive roller shaft which will be described more fully hereinbelow.

In the drying area, a drying fan motor 24 is provided to drive a drying fan 22. Drying fan 22 drives air upwards in the direction of the arrows designated by the letter U immediately above the drying fan, across a heater element, which is not visible in FIG. 4, and then against the developed x-ray films which are passing through the drying area. The drive roller support frame in the drying area is equipped with scalloped edges shown as 100 so as to insure good drying air circulation so that the edges of the films are dried, as well as the center portions of the films, as the films pass through the drying area.

Figures 5, 13, 14, 15:
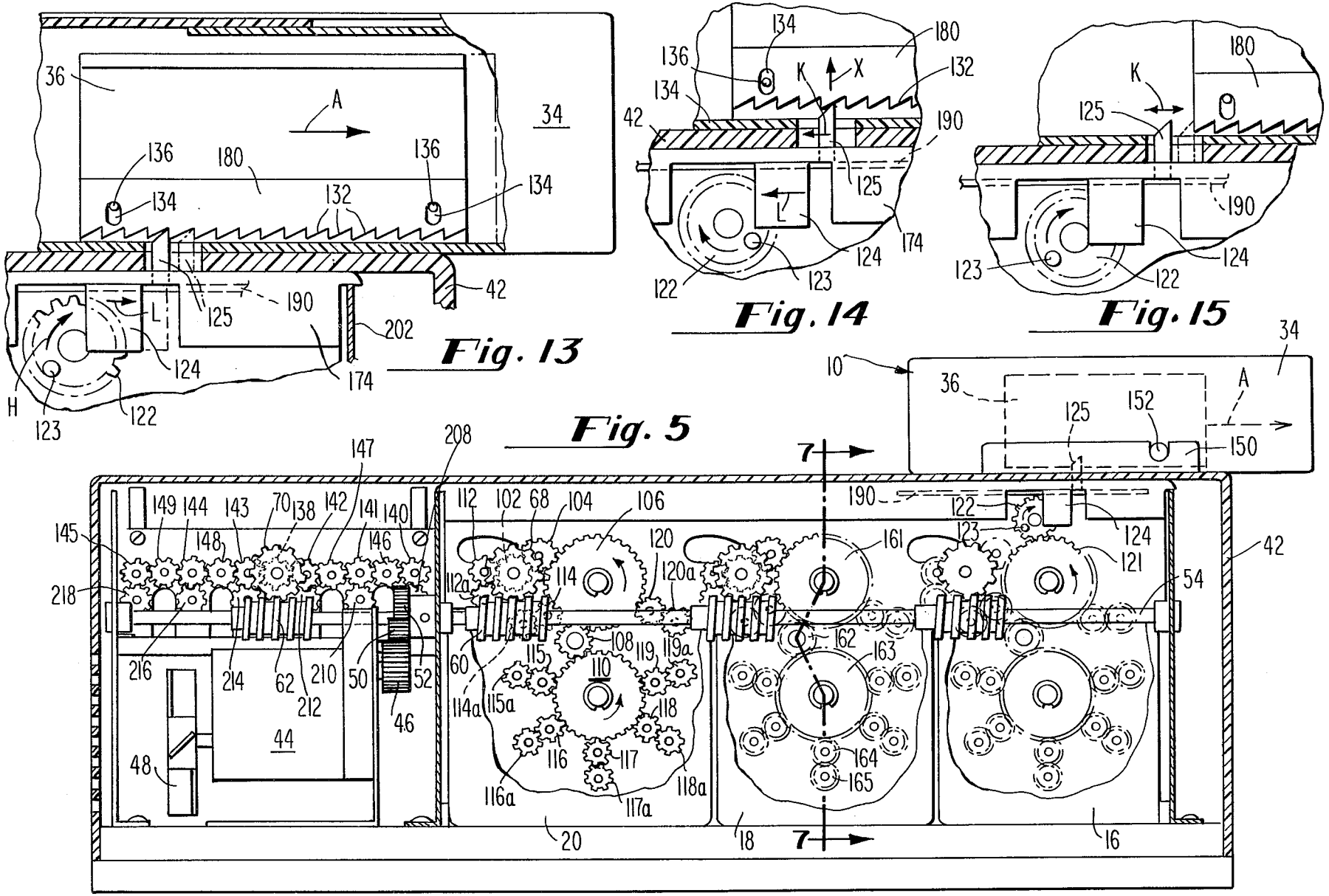
FIG. 5 is a side sectional view of the dental x-ray film processing system of the present invention, looking from the opposite side as the section taken in FIG. 4, where the section depicted in FIG. 5 is taken along the lines and arrows indicated as 5—5 in FIG. 3.
FIG. 13 is an enlarged partial, broken sectional view of the indexing means for advancing the x-ray film holder of the present invention showing portions of the magazine dispenser and housing for the developing apparatus, with the indexing means shown in a configuration whereby the x-ray film holder is being advanced.
FIG. 14 is an enlarged partial, broken sectional view of the indexing means for advancing the x-ray film holder of the present invention, showing much the same structure as FIG. 13, with the indexing means shown in a configuration it would assume after advancing the x-ray film holder by a single position.
FIG. 15 is an enlarged partial, broken sectional view of the indexing means for advancing the x-ray film holder of the present invention, showing much the same structure as FIGS. 13 and 14, with the indexing means shown in the configuration it would assume after completing the advancement of the x-ray film holder and becoming disengaged from the x-ray film holder.

Reference is now made to FIG. 5 which is a sectional view similar to that of FIG. 4 except taken from the opposite side of the dental x-ray film developing unit. The housing 42 has again been shown in section. Also the developer tank 16, the fixer tank 18, and the rinse tank 20 have been partially broken away in order to show the details of the gear drive mechanism for driving the rollers associated with each of the three tanks of liquid. The gears associated with the developer tank 16 and the fixer tank 18 have been shown only schematically. The description of the gear drives will be confined primarily to the gear drive means for the rinse tank where the gears are shown in substantial detail. It will be understood that the gear drive means for both the developer tank and the fixer tank are substantially identical to that of the rinse tank and accordingly detailed discussion of these other two gear drive means is not deemed warranted here.

The gear drive system for those gears and rollers associated with the rinse tank begins with the rinse tank drive gear 68 which is in meshed disposition with the third worm gear 60 which in turn is securedly fixer to the power transmission shaft 54. This shaft is turned by the drive motor 44 as has been previously described. The drive motor cooling fan 48 is turned by the drive motor 44 in order to provide cooling air for the drive motor.

The rinse tank drive gear has mounted on its shaft for rotation therewith a first rinse tank idler gear 102 which is shown in dotted lines in FIG. 5 since it is completely hidden in FIG. 5 by the rinse tank drive gear 68. This first rinse tank idler gear 102 is in meshed disposition both with a second rinse tank idler gear 104 and a primary drive gear 112 of an eighth pair of drive rollers associated with the rinse tank. Accordingly, upon rotation of the rinse tank drive gear 68, the first rinse tank idler gear 102 rotates thereby rotating the second rinse tank gear 104 and the primary drive gear 112 of the eighth pair of drive rollers associated with the rinse tank. Rotation of the primary drive gear 112 of the eighth pair of drive rollers associated with the rinse tank results in rotation of the secondary drive gear 112*a* of the eighth pair of drive rollers associated with the rinse tank since these two gears are in meshed disposition. The rotation of these two gears results in rotation of the eighth pair of drive rollers associated with the rinse tank, 112*b* and 112*c*, which are visible in the section view of FIG. 6.

Figure 6:
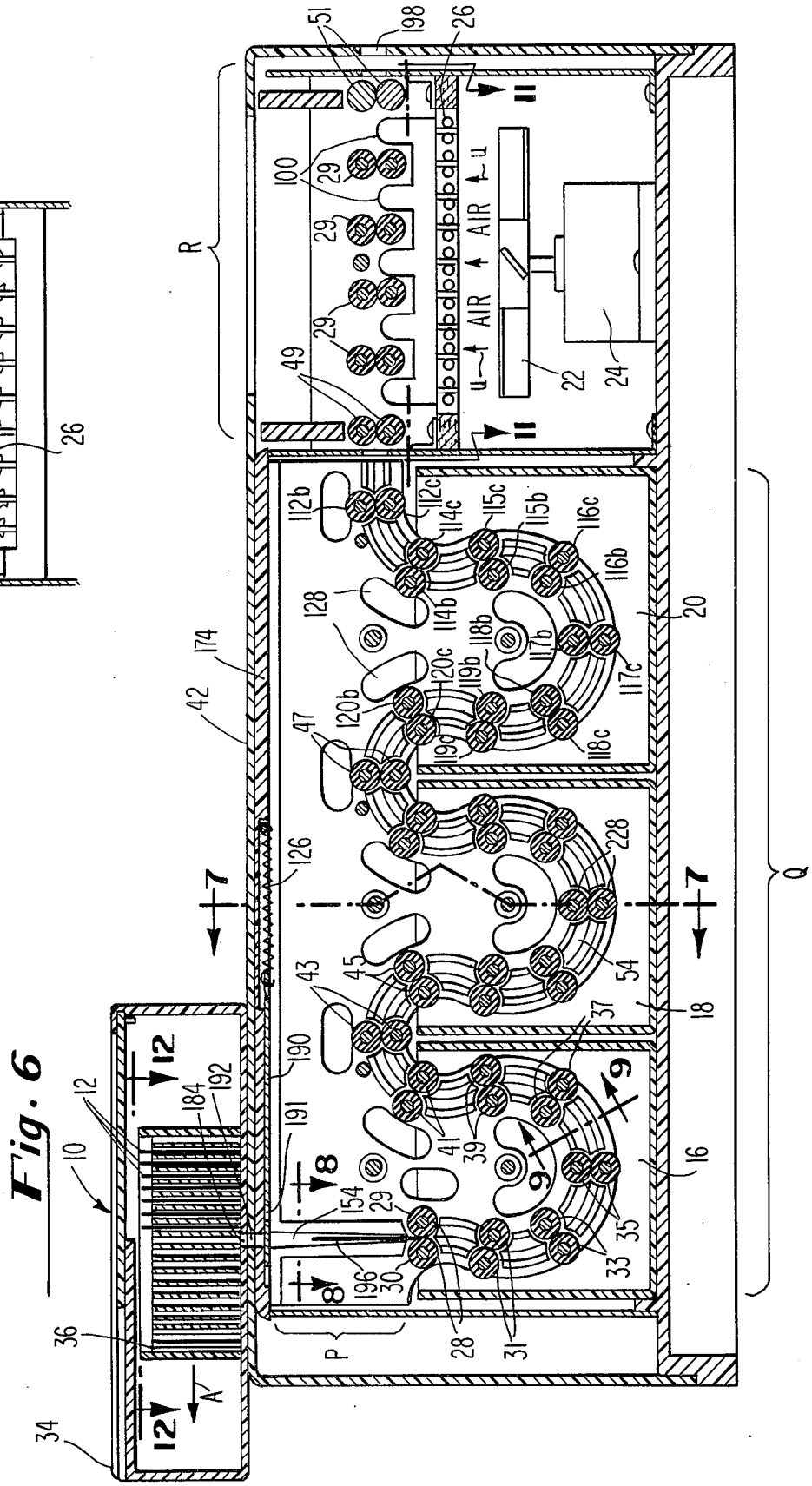
FIG. 6 is a sectional view of the dental x-ray film processing system of the present invention taken along the lines and arrows 6—6 as indicated in FIG. 3.

Rotation of the second rinse tank idler gear 104 results in rotation of the third rinse tank idler gear 106, which in turn results in rotation of the fourth rinse tank idler gear 108, which in turn results in rotation of the fifth rinse tank idler gear 110, since each of these gears is in meshed disposition with its preceedingly numbered idler gear. Additionally, the rotation of the third rinse tank idler gear 106 results both in the rotation of the primary drive gear 114 of the seventh pair of drive rollers associated with the rinse tank and in the rotation of the primary drive gear 120 of the first pair of drive rollers associated with the rinse tank, since these two primary drive gears are in meshed disposition with the third rinse tank idler gear 106. Rotation of the primary drive gear 114 of the seventh pair of drive rollers results in rotation of the secondary drive gear 114*a* of the seventh pair of drive rollers associated with the rinse tank due to these two gears being in meshed disposition. Similary, rotation of the primary drive gear 120 of the first pair of drive rollers associated with the rinse tank results in rotation of the secondary drive gear 120*a* of the first pair of drive rollers associated with the rinse tank due to these two gears being in meshed disposition. The rotation of the primary and secondary drive gears for the first and the seventh pairs of drive rollers results in rotation of the first and seventh pairs of drive rollers associated with the rinse tank, these being rollers 114*b*, 114*c*, 119*b* and 119*c* as shown in FIG. 6.

In a similar fashion to that described above, rotation of the fifth rinse tank idler gear 110 results in rotation of the primary drive gears for the second, third, fourth, fifth and sixth pairs of drive rollers associated with the rinse tank, these primary drive gears being numbered 119, 118, 117, 116 and 115. Each of these primary drive gears is in meshed disposition with an associated secondary drive gear for an associated pair of drive rollers, these secondary drive gears being respectively designated as 119*a*, 118*a*, 117*a*, 116*a*, and 115*a*. The rotation of these primary and secondary drive gears for the second, third, fourth, fifth and sixth pairs of drive rollers results in rotation of these drive rollers, 119*b*, 119*c*, 118*b*, 118*c*, 117*b*, 117*c*, 116*b*, 116*c*, 115*b* and 115*c*. These drive rollers are all seen in the sectional view of FIG. 6.

It is to be understood that the drive rollers associated with the developer tank and with the fixer tank are driven in substantially the same way as are the drive rollers for the rinse tank, via gear drive means for the associated drive rollers substantially identical to that as described for the rinse tank. Accordingly, the gear drive means for the developer tank and the fixer tank are not described in detail herein.

The gear drive means for the drive rollers in the drying area is also shown in FIG. 5. The fourth worm drive gear 62 is in meshed disposition with the drying area drive gear 70 which is mounted on a common shaft with a first drying area idler gear 138, shown in dotted lines in FIG. 5, because it is behind the drying area drive gear 70 in FIG. 5. The first drying area idler gear 138 is driven with the drying area drive gear 70 rotates due to their disposition on a common drive shaft. Rotation of the first drying area primary idler gear 138 results in rotation of the third and fourth primary drive gears 142 and 143 associated with the drying area. Rotation of the third primary drive gear 142 associated with the drying area results in rotation of the first and second primary drive gears 140 and 141 associated with the drying area, through rotation of the first and second secondary idler gears associated with the drying area, 146 and 147. Specifically, the second secondary idler gear 147 is in meshed disposition with the third primary drive gear 142 and with the second primary drive gear 141. Likewise, the first secondary idler gear 146 is in meshed disposition with the second primary drive gear 141 and the first primary drive gear 140, all of which are associated with the drying area. Consequently, rotation of the third primary drive gear 142 results in rotation of the first and second primary drive gears 140 and 141 in the same direction as the third primary drive gear's rotation due to the presence of the first and second secondary idler gears 146 and 147 associated with the drying area.

In a similar fashion, rotation of the fourth primary drive gear 143 due to its being in meshed disposition with the first drying area idler gear 138, results in rotation of the fifth and sixth drive gears 144 and 145 associated with the drying area through the intermediary third and fourth secondary idler gears 148 and 149 associated with the drying area.

Rotation of the primary drive gears 140, 141, 142, 143, 144 and 145 associated with the drying area also results in rotation of the respectively corresponding secondary drive gears 208, 210, 212, 214, 216 and 218, due to these gears each respectively comprising first through sixth pairs of drive roller drive gears, designated as drive roller gear pairs one through six, with primary drive gear being in meshed disposition with a corresponding respective secondary drive gear for driving of the corresponding respective secondary drive gear thereby, as is shown in FIG. 5.

Also shown in FIG. 5 is the magazine dispenser 19 with the x-ray film holder 36 shown in dotted lines. The arrow A shows the direction of travel of the x-ray film holder as it travels longitudinally in the magazine dispenser housing to dispense its films therefrom. The magazine dispenser is held in place by a guide rail 150 which serves as a locating means for locating the magazine dispenser. The magazine dispenser has a position means designated as 152 which is a pin disposed for fitting into a complementally shaped notch in the guide rail 150. This notch in the guide rail 150 may also be designated as a position means receiver for receiving the position means pin 152.

Figure 7:
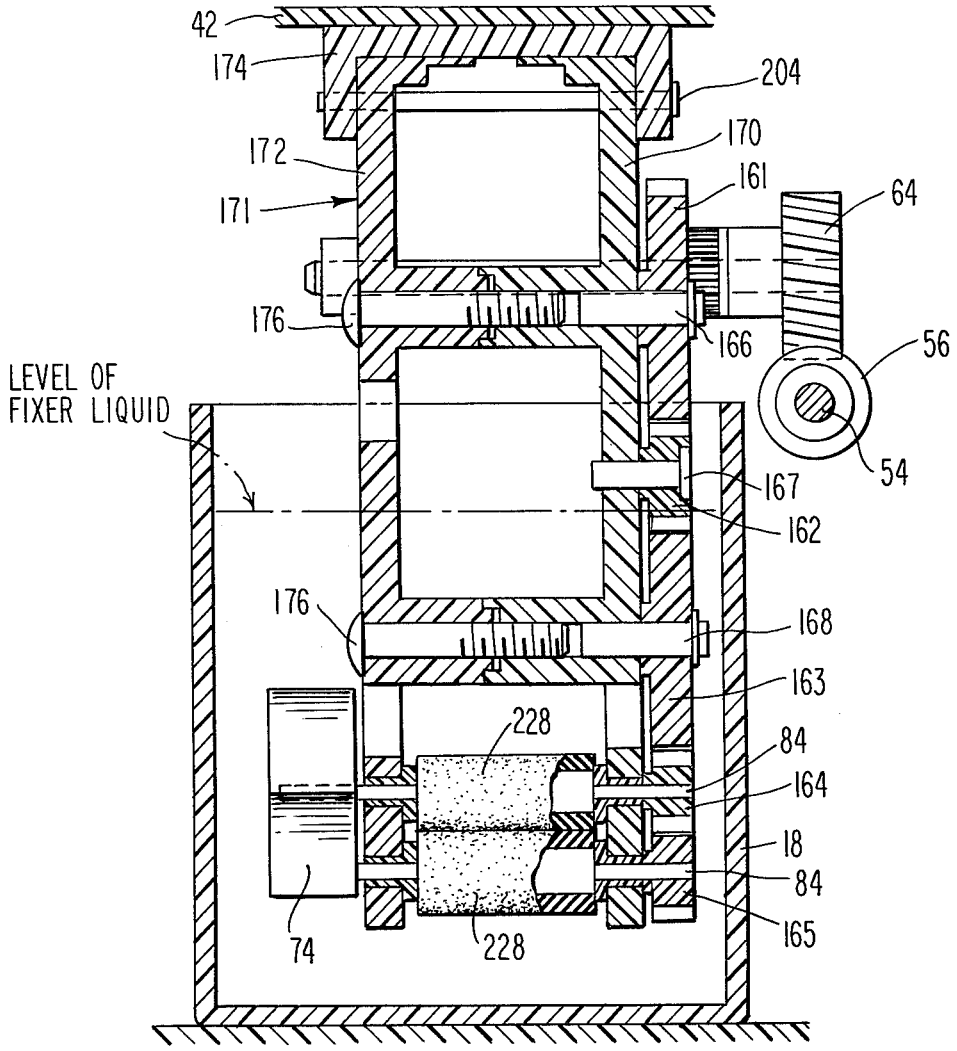
FIG. 7 is a sectional view taken along the lines and arrows 7—7 as shown in FIG. 6 and in FIG. 4, of the dental x-ray film processing system of the present invention.

Still referring to FIG. 5, the third, fourth and fifth idler gears associated with the fixer tank have been designated 161, 162 and 162 for aid in identifying them in FIG. 7, since FIG. 7 represents a sectional view taken along the lines and arrows 7—7 as shown in FIG. 5. Likewise the primary and secondary drive gears for the fourth pair of drive rollers associated with the fixer tank, 164 and 165, have been designated in FIG. 5 for aid in understanding FIG. 7 since the section which FIG. 7 represents also cuts through these two drive gears.

Still referring to FIG. 5, reference is now made to the third developer tank idler gear 121. This idler gear is in meshed disposition with an index gear 122 which has an index pin 123 protruding from the side thereof. The index pin is mounted off center with respect to the axis of rotation of the index gear 122. The index pin 123, upon rotation of the index gear 122 will strike an index tab 124 once with every rotation of the index gear 122. The index tab then moves in response to this force which has been exerted on it by the index pin 123, thereby moving an index pring 125 which extends upwards out of the housing 42 and into the magazine dispenser 10, when the magazine dispenser is in place, on top of the housing, as is shown in FIG. 5. The index gear 122, the index pin 123, the index tab 124, the index prong 125, and the index spring shown as 126 in FIG. 6 together act as an indexing means for advancing the x-ray film holder 36 in the magazine dispenser 10, thereby allowing the x-ray films held in the x-ray film holder 36 to drop, one by one, into the housing containing all the elements required for developing, fixing, rinsing and drying the individual x-ray films. More detailed explanation of the indexing system is provided hereinbelow.

Reference is now made to FIG. 6, which is another sectional view taken along lines and arrows 6-6 of FIG. 3. In FIG. 6, the magazine dispenser 10 is shown in sectional view in place on the top of housing 42 with a plurality of individual x-ray films 12 shown in place in the x-ray film holder 36 contained within the outer portion 34 of the film magazine dispenser 10. The arrow designated by the letter A indicates the direction of travel of the x-ray film holder within the magazine dispenser as the individual x-ray films are dispensed into the housing. The individual x-ray films are sequentially dropped, one by one, through first slot 184 in the magazine dispenser and then through first slot 192 in the housing means. These two slots are in aligned disposition when the magazine dispenser is in position above the housing means with the position means of the magazine dispenser in engagement with the position means receiver of the housing means, as was shown in FIG. 5. Shutter means 190 is opened by the index means, which was described with reference to FIG. 5 and which will be described in greater detail hereinafter, by the index means pushing against the force exerted by spring means 126. The shutter means 190 is opened at the same time the x-ray film holder 36 in the magazine dispenser 10 is advanced one position so that an individual x-ray film, if one be in the particular slot in the x-ray film holder which is then aligned over slots 184 and 192, can fall into the housing and begin to be processed as it travels along the film guide path means which has been designated as 154. Such a typical film which has fallen into the housing is shown in FIG. 6 and is designated as 196. The film 196 falling into the housing enters the film guide track means, designated generally as 154, which guides each x-ray film successively through a tank of developer, a tank of fixer, a tank or rinse, and then to a drying area after exit from which the film is ejected from the housing. A film which has been processed and has completely traveled through the film guide track means 154 and the drying area will be ejected from the housing through the second slot means 198 in the housing 42.

Referring now to the film guide track means which has been designated generally as 154, it is to be understood that the film guide track means is divided into two connected segments or portions. These two portions are the first portion, which has been designated by the letter P and has a bracket indicating the portion of the film guide track means which is associated with the letter P, and the second portion which has been designated by the letter Q, which is essentially the portion of the film guide track means which guides the films through the three tanks of liquid developer, fixer and rinse.

In the drying area, the area designated by the letter R and the bracket, the films travel along a straight path and consequently a minimum of guiding of the films is required. In this area, the films are guided by the pairs of drive rollers which propel the films through the drying area; when a film enters the drying area along a straight line path upon leaving the end of the portion Q of the guide track means, it will continue along that straight line path as it is propelled by the rollers until it exits from the developing apparatus.

It is to be understood that the first portion of the film guide track means, designated by the letter P, is a tapered portion of the film guide track means which is designated so that the widest portion of the film guide track means, at the top or upper-most position of the portion designated by the letter P, is of at least the same cross-sectional area as the first slot 192 in the housing. The portion P of the film guide track means then tapers so that a film falling through the first portion of the film guide track means must pass into the juncture between drive rollers 29 and 30 which comprise the first pair of drive rollers designated by the number 28. These rollers rotate in the direction shown by the arrows in FIG. 2 and consequently serve to force an individual film on its way through the guide track means 154. It is to be understood that the pairs of rollers are spaced apart one from another, such as the spacing between roller pair 28 and roller pair 31, a distance such that a single x-ray film is always grasped between at least one pair of rollers.

The portion of the guide track means designated by the letter Q is substantially continuously curved as the guide track means in conjunction with the pairs of drive rollers transports the individual films initially into and then out of the developer tank 16, then into and out of the fixer tank 18 and finally into and out of the rinse tank 20, and on to the drying area designated by the letter R. The rollers, which are shown in section FIG. 6, and which are associated with the developer tank and the rinse tank have been numbered so that those rollers may be identified as the same rollers which are referred to schematically in FIG. 2, so as to make the structure and operation of the present invention even more clear to one of ordinary skill in the art.

Similarly, in the region of the developing apparatus designated by the letter R, roller pair 49 and roller pair 51 have been identified so that these may be compared to those shown in FIG. 2. Again, the drying fan motor 24 turning the drying fan 22 forces hot air up, in the direction of the arrows designated by the letter U, through a heater element 26 and against the developed x-ray films as they move through the drying area portion of the developing apparatus. It will again be noted that the edges of the roller support frame in the drying area are of scalloped configuration, as designated by numeral 100, so as to insure good air circulation in the drying is assured so that the edges of the films passing through the drying area are dried as are the central portions of the films.

The eight pairs of rollers associated with the rinse tank, for which the gear train drive was described in extreme detail with reference to FIG. 5, have been numbered beginning with **112*b* through 120*c* in order to aid one reading this specification to correlate the appropriate drive gears shown and described with reference to FIG. 5 with the appropriate film drive rollers shown here in FIG. 6. Correspondingly numbered gears drive correspondingly numbered rollers. For example, primary drive gear 116 drives roller 116*b* while secondary drive gear 116*a* drives roller 116*c***.

Reference is now made to FIG. 7 which is a sectional view taken along the lines and arrows 7—7 as shown in FIG. 6, showing a cross-sectional view of the roller support frame which has been designated generally as 171. This roller support frame in the liquid holding tank area, as designated by the letter P and Q, is comprised generally of two half pieces, a first half of the roller support frame 170 and a second half of the roller support frame 172. The roller support frame is secured to a U-frame 174 for securing together the halves of the roller support frame. This U-frame 174 supports the roller support frame 171 from above, by fitting over vertical partitions 200 and 202 within the housing 42. This is shown more clearly in FIG. 4. The U-frame is secured to the two halves of the roller support frame by pin means 204, a plurality of which is provided for so securing the U-frame to the roller support frame halves. The two halves of the roller support frame are also secured together by a plurality of bolts designated as 176 with the first half of the roller support frame 170 having threads therein for engagement with the bolts 176.

Also shown in FIG. 7 are sectional views of the fixer tank 18, the third, fourth and fifth fixer tank idler gears 161, 162 and 162, the primary drive gear 164 of the fourth pair of drive rollers associated with the fixer tank and the secondary drive gear 165 of the fourth pair of drive rollers associated with the fixer tank. Additionally, there are shown the drive roller shafts for the pair of drive rollers designated as 228 which is the fourth pair of drive rollers associated with the fixer tank. A paddle 74 for mixing the fixer fluid is mounted on one of the drive roller shafts 84 for rotation therewith in the fixer fluid. A typical level or fixer liquid in the fixer tank is shown also in FIG. 7.

The power transmission shaft 54 and the first worm gear 56 are shown, with the power transmission shaft 54 being in section and with the first worm gear 56 being in engagement with the developer tank drive gear 64. Also, in FIG. 7, the third, fourth and fifth idler gears associated with the fixer tank are shown mounted on stub shafts 166, 167 and 168. These gears are mounted on the stub shafts in a conventional manner well known in the mechanical arts and likewise the stub shafts are mounted in the first half of the roller support frame 170 in any suitable manner, many of which are well known in the mechanical arts. The U-frame 174 for securing together the halves of the roller support frame is shown in contact with the housing 42. However, it is to be understood that the housing is distinctly removeable from the parts inside thereof and that there is no positive fastening between the housing 42 and the U-frame 174.

Figure 8:
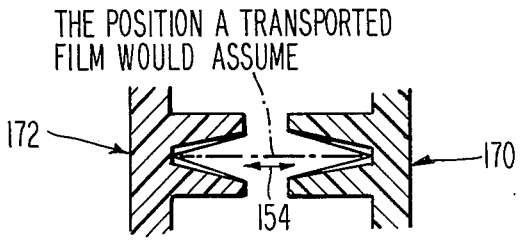
FIG. 8 is a sectional view, taken along the lines and arrows 8—8 shown in FIG. 6, of the initial entry portion of the dental x-ray film transport guide means through which the dental x-ray films initially travel as they pass through the dental x-ray film processing system.

Reference is now made to FIG. 8 which is a cross-sectional view, taken along the lines and arrows 8—8 as indicated in FIG. 6, of the tapered portion of the film guide track means 154 designated by the letter P and the bracket in FIG. 6. FIG. 8 shows portions of the first half of the roller support frame 170 and the second half of the roller support frame 172 broken away from the remainder of the roller support frame with the tapered portion of the film guide track means 154 designated by arrows. The position that a transported film would assume, as the transported film drops through the film guide track means portions designated by the letter P, is designated by the center line through the slot in FIG. 8. It is to be emphasized that the portion of the film guide track means 154 shown in FIG. 8 exists as a formed or molded tapered groove in the two halves of the roller support frame 170 and 172. The upper most portion of the groove, with the flattened bottom as indicated by the arrow L, is of substantially the same size as the first slot means in the housing 192, shown in FIG. 6, so that individual films dropping into the housing from the magazine dispenser 10 fall directly into the tapered film guide track means 154. The bottom portion of the tapered film guide track means is substantially identical to the portion of the film guide track means shown in section in FIG. 9, which is described below, wherein the film guide track means 154 has V-shaped edges at the extremities of its grooves for guiding the films along. Indeed, it is to be understood that the portion of the film guide track means shown in section in FIG. 8 mates continuously into the portion of the film guide track means shown in section in FIG. 9 as is clear from inspection of FIG. 6.

Figure 9:
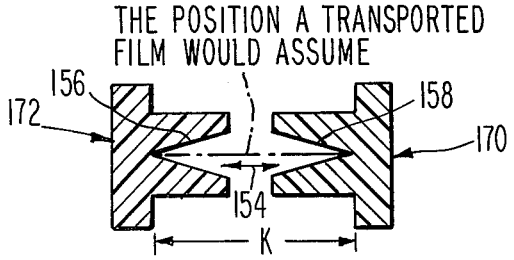
FIG. 9 is a sectional view of the dental x-ray film guide path means taken along the line and arrows 9—9 as indicated in FIG. 6.

FIG. 9 is a sectional view of the film guide track means taken along the portion of the film guide track means designated by the letter Q in FIG. 6, wherein the film guide track means, which is the slot 154, exists as a formed or molded slot or V-shaped groove in the two halves of the roller support frame 170 and 172. A transported film would assume the position shown by the center line in the tapered slot shown in FIG. 9. The left and right hand film guide track means in the untapered portion Q of the film guide track means have been designated as 156 and 158. It is to be emphasized that this portion of the film guide track means, similarly to that portion in FIG. 8, exists as a portion which is formed or molded into the two halves of the roller support frame 171. The space between the two halves 170 and 172 of the roller support frame in the area of the film guide track means allows for the flow therethrough of liquid developer, fixer or rinse depending upon the specific tank in which a particular portion of the film guide track means in the roller support frame is located. Likewise, this open area provides for the rapid drainage of the liquid developer, fixer or rinse from the guided films as they pass along the film guide track means above the tanks.

Figure 10:
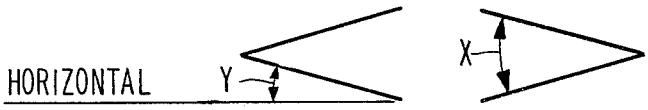
FIG. 10 is a diagramatic view of the angle of construction of the film guide path means shown in FIG. 9.

FIG. 10 is a schematic view of the angles involved in the untapered portion of the film guide track means designated by the letter Q in FIG. 6 and as shown in section in FIG. 9. The angle X shown in FIG. 10 represents the angle formed at the V-juncture of the groove or slot of the film guide track means in the preferred embodiment of the present invention. Angle Y represents the angle of one surface of the film track means or groove, a lower surface when the film guide track means is in a horizontal position, (such as when the film guide track means is disposed midway between two of the tanks through which it travels) showing the disposition from the horizontal of the film guide track groove lower surface. In practice, it has been found that constructing the film guide track means with the angle X in the neighborhood of 30° and with the angle Y in the neighborhood of 15°, so that the angle X is centered symetrically with respect to a vertical plane, has proved quite advantageous. However, it is to be understood that neither these angles nor the symmetry is critical for the successful operation of the x-ray film processing system of the present invention and that any suitable angles or shapes (such as square bottoms of the grooves) may be provided so long as the films pass easily through the film guide track means.

It has been found most advantageous to construct the film guide track means with the V-shaped grooves separated by a distance, denoted by the dimensional letter K in FIG. 9, of 1 and 5/16 inches plus or minus engineering tolerances. In this connection, engineering tolerances are generally thought to be plus or minus one/thirth-two of an inch. Although the processing system of the present invention has been found to operate quite successfully with the guide track means constructed with these angles, dimensions and tolerances, it is to be explicitly understood that a wide range of groove shapes, groove angles, groove dimensions and engineering tolerances may be used in constructing a successfully operating embodiment of the present invention and that the present invention is in no way to be construed to be limited to the groove shape, groove angle, groove dimension and engineering tolerances listed above.

Figure 11:
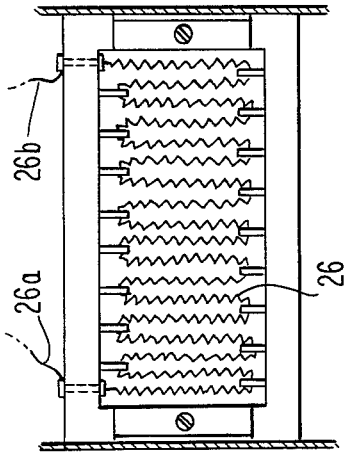
FIG. 11 is a partial sectional view of the heater apparatus of the dental x-ray film processing system of the present invention taken along the lines and arrows 11—11 of FIG. 6.

FIG. 11 is a sectional view taken along the lines and arrows 11—11 as shown in FIG. 6. FIG. 11 shows the heater means through which air blows when the air is driven by the drying fan 22 across the film path as defined by the drive rollers in the drying area. This is the area of the developer apparatus designated by the letter R and the bracket in FIG. 6. The heater means 26 is typically a conventional electrical resistance heater, with wire leads **26*a* and 26*b*** which lead to an appropriate power source, for providing heat so as to increase the drying effect of the air which is being blown over the exposed and developed x-ray films as they pass through and are guided by pairs of film drive rollers in the drying area.

Figure 12:
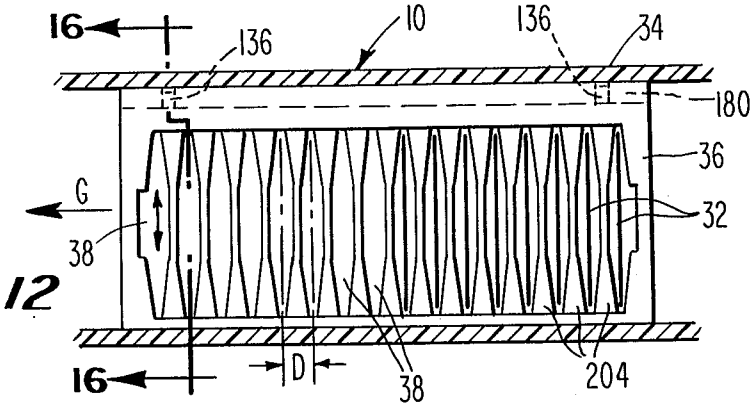
FIG. 12 is a partial sectional view of the dental x-ray film magazine dispenser of the processing system of the present invention taken along the lines and arrows 12—12 as shown in FIG. 6.

FIG. 12 is a top broken partial section view of the magazine dispenser of the present invention where the outer portion of the film magazine dispenser 34 has been shown in section and has been broken away so as to reveal the x-ray film holder 36, a plurality of x-ray films 32 contained in the x-ray film holder, a remaining number of x-ray film holder slots 38 and the x-ray film holder rack 180 which is moveably fastened to the x-ray film holder by pin means 136 which are support means for the x-ray film holder rack, extending through slots in the x-ray film holder rack. The pin means 136 are securedly retained in the x-ray film holder 36 and allow movement of the x-ray film holder rack 180 vertically but not horizontally with respect to the x-ray film holder 36. The relationship of the support pins 136 for the x-ray film holder, the x-ray film holder rack 180, the x-ray film holder 36 and the slots in the x-ray film holder rack 134, will become clear from the description below of the operation of the indexing means which indexes the x-ray film holder along the length of the magazine dispenser so as to dispense the x-ray films contained in the x-ray film holder, one at a time, from the magazine dispenser, and from an inspection of FIGS. 13, 14, 15 and 16.

For an explanation and understanding of the operation of the index system or indexing means by which the individual x-ray films in the magazine dispenser 10 are individually dispensed into the housing 42 containing the developing apparatus, reference is now made to FIGS. 13, 14 and 15. FIGS. 13, 14 and 15 are all partial broken sectional views of the indexing means for sequentially dispensing individual x-ray films into the x-ray film processor-developer apparatus housing 42. The dispensing means includes the x-ray film holder 36, the outer portion of the x-ray film magazine dispenser 34; the indexing means, which is a means for advancing the x-ray film holder in the magazine dispenser, consists of the index gear 122, the index pin 123. The index tab 124, the index prong 125, the x-ray film holder rack 180, the tooth rail portion 132 of the x-ray film holder rack, the support pins 136 for the x-ray film holder rack and the slots 134 in the x-ray film holder rack.

Figure 16:
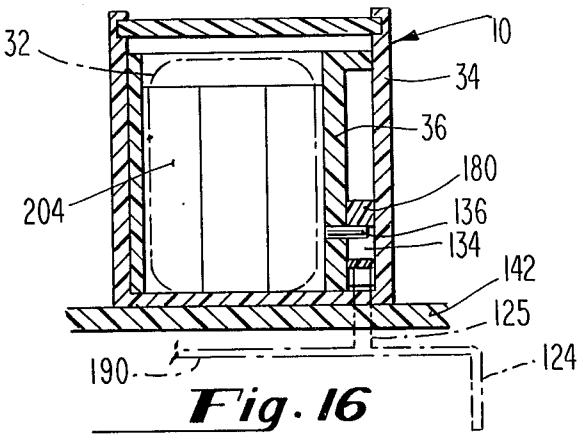
FIG. 16 is a sectional view of the magazine dispenser portion of the dental x-ray film processing system of the present invention taken along the lines and arrows 16—16 as shown in FIG. 12.

Reference is now made to FIG. 16 which is a sectional view of the magazine dispenser apparatus taken along the lines and arrows designated by the numbers 16—16 in FIG. 12. In FIG. 16, the magazine dispenser apparatus designated generally as 10 is shown in a sectional view, with the outer portion of the film magazine dispenser 34 enclosing the x-ray film holder designated generally as 36 and the x-ray film holder rack designated generally as 180. A partition 204 is shown. A plurality of these partitions 204, such as are shown in FIG. 12, form the slots 38 for the residence of the x-ray films therein, one x-ray film in a slot. A single x-ray film has been shown in phantom lines and designated as 32 in FIG. 16. The support pins for the x-ray film holder rack have been designated as 136 in FIG. 16 and the x-ray film holder rack 180 has been shown in engagement with the index prong 125 which has been shown in phantom lines. A portion of the housing 42 on which the x-ray film magazine rests has been shown broken away in sectional view and the index tab 124 and the shutter means 190 have been also shown in phantom lines similarly to the index prong 125. It should be clear that the x-ray film holder rack 180 is structurally connected to the x-ray film holder 36 only by the pin means 136 in sliding engagement in the slots 134 and hence that relative vertical movement between the x-ray film holder rack 180 and the x-ray film holder is permitted, but relative horizontal movement between these two elements is not permitted by this arrangement.

Figure 17:
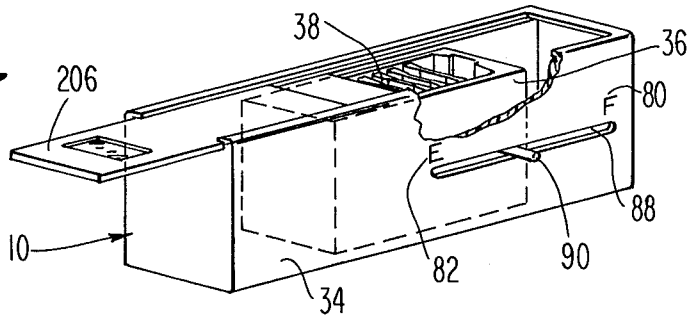
FIG. 17 is a partially broken away isometric view of the magazine dispenser portion of the dental x-ray film processing system of the present invention showing the magazine dispenser in an open condition, with the x-ray film holder visible therein.

Reference is now made to FIG. 17 showing the x-ray film magazine dispenser in an isometric view wherein the magazine dispenser is designated generally as 10 and consists of an outer portion of the film magazine dispenser 34 and an inner portion including the x-ray film holder designated as 36. The x-ray film holder has individual film slots 38 therein for the insertion of the x-ray films into the x-ray film holder. A third slot means 88 in the magazine dispenser 10 has protruding therethrough an advancement pin means 90 which is secured to the x-ray film holder 36 and which allows manual movement of the x-ray film holder along the inside length of the outer portion 34 of the film magazine dispenser. Indicia 80 and 82 are provided so as to indicate, in conjunction with the advancement pin 90, the position of the x-ray film holder with respect to the outer portion of the film magazine. A sliding door portion 206 of the magazine dispenser is provided for allowing access to the magazine dispenser 10 so as to easily place x-ray films to be developed into the x-ray film holder. Once films are placed in the x-ray film holder, in a dark room, the sliding door 206 is manually slid closed and the x-ray film magazine dispenser becomes a substantially light-tight box ready for placement in mating disposition with the housing 42 containing the developing apparatus. This mating disposition has been described above with reference to FIG. 5, wherein the interaction of the position means 152 and a position means receiver notch in a guide rail 150 which extends from the housing was described.

Initially, when the dentist or his assistant desires to process one or more exposed dental x-ray films, the sliding door portion 206 (visible in FIG. 17) of the magazine dispenser 10 is manually slid open so as to open the magazine dispenser 10, and the advancement pin means 90, which is visible in FIGS. 4 and 17 is moved manually so as to make the x-ray film holder 36 accessible through the opening which was created by moving the sliding door. This is depicted in FIG. 17. Once the x-ray films are loaded into individual x-ray film holder slots 38 as shown in FIG. 12, and it must be emphasized that the x-ray films need not be loaded into contiguous slots but can be loaded into any chosen slots so long as only one x-ray film is placed in any single slot, the sliding door 206 of the magazine dispenser 10 is slid shut by the dentist or his assistant, and the advancement pin means 90 is moved so that it is positioned under the indicia letter F which is shown in FIG. 17. These steps should be performed in a darkened area so that the x-ray films are not exposed to excessive light. Once these steps have been performed, the closed magazine dispenser 10 can be moved into a lighted area whereupon the advancement pin means 90 is moved to the end of the slot means 88 in the x-ray film magazine 10, which is denoted by the letter F as seen in FIG. 4, if this was not done previously. This denotes that the x-ray film magazine dispenser is filled with at least one x-ray film and is ready to be placed in position on the housing.

The x-ray film magazine dispenser 10 is then placed in position on the housing 42 with the first slot means 184 in the x-ray film magazine dispenser in coincidental disposition with the first slot means 192 of the housing 42, as shown in FIG. 3. This is done by locating the magazine dispenser with its position means or its magazine dispenser pin 152, which is disposed for fitting into a notch in a guide rail attached to the housing, fitted into that notch in the guide rail 150 of the housing as is shown in FIG. 5. At this point, the system is activated by providing electrical energy to the drive motor and this, via the gear train drive means initiates rotation of the index gear 122.

As the index gear 122 rotates in the clockwise direction shown in FIG. 13 and as depicted by the arrow H, the index tab 124 will be contacted by the index pin 123 and the index tab 124 will be driven to the right, in the direction indicated by the letter L, thereby tending to compress the index spring 126, which is shown in FIG. 6. This movement of the index tab 124 to the right results in a movement of the extending index prong 125 to the right as shown in FIG. 13 and also results in an opening of the shutter means 190, since the shutter means exists as an extension of the index tab 124, by aligning the slot 191 in the shutter means with the slots in the magazine dispenser and the housing. As the shutter means 190 moves, as the index gear 122 rotates, the shutter means does not reach its open position, where a film is allowed to drop from the magazine 10 into the housing 42, until the index pin 123 has pushed the index tab 124 to the extreme right hand limit of its travel as viewed in FIG. 13. When this has occurred, the index prong 125 has moved the x-ray film holder rack one position to the right, as designated by the letter A and thus has also moved the x-ray film holder one position to the right thereby allowing a first or next x-ray film, if any, to drop through the slot 184 in magazine dispenser, the slot 192 in the housing, and the slot 191 in the shutter means 190, thereby dropping from the x-ray film holder into the housing for processing. After the index tab 124 has reached the extreme right hand limit of its travel as shown in FIG. 13, thereby compressing the index spring 126 and moving the film holder 36 one position, the index gear 122 continues to rotate thus moving the index pin 123 out of engagement with the index tab 124 and producing the condition shown in FIG. 14. In this condition, the index spring will push the index tab 124, the shutter means 190 and the index prong 125 to the left as shown in FIG. 14 by the arrow L. Due to the beveled upper edge of the index prong 125, as the index prong 125 moves to the left, the x-ray film holder rack 180 moves vertically on the pins 136 in the slots 134 as shown by the letter in FIG. 14. This movement of the x-ray film holder rack is vertical with respect to the x-ray film holder; this movement is allowed by the vertically oriented slots 134 in the x-ray film holder rack 180 which slidably retain the pins 136 which are securedly affixed to the x-ray film holder 36. As the index prong 125 continues to move to the left, as shown in FIG. 14 by the arrow K, the state wherein the index prong 125 has come into engagement with a next tooth 132 of the x-ray film holder rack 180 will occur upon the index prong 125 moving over its full length of travel to the left as shown in FIG. 14. When this has occured, the index prong 125 will be in engagement with a next tooth 132 on the x-ray film holder rack 180 and the conditions shown in FIG. 13 will be reattained. At this point the cycle is repeated thus dispensing another x-ray film, if one be present in the particular slot of the x-ray film holder which is then aligned with the shutter opening, into the housing. It is to be understood that when the operator has moved the advancement pin means 90 to the position designated by the letter F in FIG. 4 and then has inserted the magazine dispenser into engaged relation with the housing by using the position means 152 in conjunction with the guide rail 150 for locating the magazine dispenser, the index prong 125 will necessarily be in engagement with the first tooth of the film magazine holder rack. Consequently, when the apparatus is actuated and the index gear 122 is rotated, advancement of the x-ray film holder in the direction indicated by the letter A in FIG. 13 will be automatically initiated, without further manipulations on the part or the operator being necessary.

In a similar fashion, when the x-ray film holder 36 has travelled the maximum extent of its travel, in the direction shown by an arrow designated by the letter A in FIGS. 5 and 13, the index prong 125 will have a relation to the film holder rack 180 as is shown in FIG. 15. That is, the index prong 125 will have moved the x-ray film holder rack 180 to the extreme right-hand position shown in FIG. 15. Thereafter, if the processing system continues to be actuated, the index prong 125 will merely move back and forth in the direction shown by the arrows K in FIG. 15, without further engaging the x-ray film holder rack 180. This situation will continue so long as the index gear 122 is rotating, due to the alternating effect of the index pin 123 forcing the index tab 124 to the right in FIG. 15 and the index spring 126 forcing the index tab 124 and hence the index prong 125 back to the left also as seen in FIG. 15.

Once the operation of the indexing system for dispensing the individual x-ray films from the x-ray film holder in the x-ray film magazine into the housing is understood, operation of the total system becomes clear. For understanding the operation of the total system, reference is best made to FIGS. 1, 2, 4, 5, 6, 7, 12, 13, 14, 15 and 17.

After the dentist or his assistant has taken the appropriate x-rays, the dentist or his assistant will take the x-rays into his dark area and remove the exposed films from the devices which are used to secure the films within the patients mouth or within the appropriate x-ray machine. The exposed films will then be placed in the x-ray film slots 38 in tge x-ray film holder 36 in the magazine dispenser designated generally as 10, with the sliding door 206 in the position such as is shown in FIG. 17. The films can be placed in any of the slots 38 in the x-ray film holder 36, the only requirement is that only a single film be placed in a single slot. The films need not be placed in contiguous slots. Once the films are in the x-ray film dispenser, the dentist or his assistant will slide the sliding door 206 into the closed position, thus closing the magazine dispenser pin and will also move the pin 90 to the extreme right hand position which could be obtained, when looking at the magazine dispenser as it is shown in FIG. 17, under the indicia F. At this point, the magazine dispenser is ready to be placed in engagement with the housing 42 which contains the film developing apparatus, as described above.

The dentist or his assistant now places the magazine dispenser in engagement with the housing 42 by carefully placing the magazine dispenser on the housing, ensuring that the position means pin 152 which protrudes from the magazine dispenser is in appropriate engagement with the notch in the guide rail 150 for locating the magazine dispenser with respect to the housing. At this time, since the pin 90 had been moved all the way to the right as described above, the index prong 125 will be in engagement with the first tooth of the x-ray film holder rack. The dentist or his assistant now actuates the dental x-ray film developing system by applying a suitable voltage via a switch or plug-in cord to the drive motor 44. This results in the drive motor rotating the power transmission shaft 54 with resultant rotation of all the drive gears in the system. This rotation also results in the rotation of the index gear 122 which starts the indexing, as described above, into operation. The indexing system will advance the x-ray film holder, as described above, by a distance D as shown in FIG. 12, each time the index gear 122 makes one complete rotation. For each rotation of the index gear, the index prong 125 moves laterally as shown by the letter K in FIGS. 14 and 15 and advances the x-ray film holder rack one position. Likewise, for each rotation the index gear 122, at the extreme right hand travel of the index prong 125 as shown in FIG. 5, the shutter means 190 opens thereby allowing an x-ray film contained in an appropriately positioned x-ray film slot 38 to drop through and enter into the housing through the slot means 184 and 192 and to begin travel through the film guide path means 154. Once a single film has entered the film guide path means, it will be successively guided, by force exerted thereon by the pairs of driving rollers, through the developer tank, the fixer tank, the rinse tank, and the drying area as shown schematically in FIGS. 1 and 2 and as shown in FIG. 6. So long as the apparatus is in operation, the indexing mechanism will continue to operate and will continue to successively attempt to advance the x-ray film holder thereby allowing each film contained in x-ray film holder, if one or more films be contained therein, to drop into the housing apparatus and be processed through the tanks and drying area by travelling along through the film path. Specifically, if it is assumed that there are M film slots in the x-ray film holder and these are filled with N films where N must necessarily be less than or equal to M since each slot 38 can only be filled with a single film 12, the indexing means will operate to advance the x-ray film holder at least M times so that each film, no matter what film position 38 a film be resident in, has an opportunity to pass down out of the x-ray film holder and drop into the processing unit to begin its passage through the developer, fixer and rinse tanks and through the drying area. For instance, if the first film slot in the x-ray film holder is designated by the integer number Z as the Z film slot, the second film slot in the x-ray film holder is designated as the Z + 1 film slot, etc., where Z can at most equal M, and any films contained in the film slots are assigned numbers corresponding to the slot in which the film is contained, the indexing means, once activated, would be permitted to operate at least until all Z films had been processed by the system and removed therefrom. If it is assumed that the system can accommodate at a single time only a single x-ray film each in the developer tank, the fixer tank, the rinse tank and the drying area, and if it is assumed that one rotation of the index gear can result in the introduction of only one film into the developer unit and in the advancement of all films in the developer unit into their next respective positions e.g. from the developer tank to the fixer tank, from the rinse tank to the drying area, etc., once the first or Z film slot is in place over the receiving slot 192 in the housing 42 of the developing apparatus, rotation of the index gear M-1 times will result in the dispensing of all the films in the x-ray holder into the developer apparatus. Four (4) more rotations of the index gear will insure that the last film which was dispensed into the developer apparatus, will be ejected therefrom, the four rotations being required to move the film from the developer tank to the fixer tank, then to the rinse tank, then to the drying area and then to eject the film from the apparatus. Thus, if the x-ray film holder is in an initial disposition whereby if it is advanced by a single position, the first film slot will then be located above the slot in the magazine dispenser through which the films are dispensed into the developer apparatus, it may be said that by rotating the index gear M + 4 times, any and all films contained in the x-ray film holder will be dispensed therefrom and will be completely processed through and ejected from the developer apparatus. Similarly, for other combinations of the variables (the number of film slots in the film holder, the ratios of the numbers of teeth in the various meshed gears one to another in the gear drive means system and in the indexing means system, the number of flims which can be accommodated at one time in the developer tank, in the fixer tank, in the rinse tank and in the drying area, and the rate at which films can be moved through and between these tanks) the mathematical relationship between the maximum number of films which can be contained in the film holder and the number of index gear cycles or rotations required for dispensing, processing and ejection of all the films can be easily determined. Likewise, once the x-ray film holder has been moved to the extreme right-hand position in the direction shown by the letter A in FIG. 5, the indexing mechanism will continue to cycle back and forth in the state shown in FIG. 15 as the N films are successively processed through the developer, fixer and rinse tanks and through the drying area. It is specifically to be understood that if a film is not present in one slot 38 of the x-ray film holder 36, the system will continue to operate until electrical power to the system is shut off. Accordingly, it is necessary for the system to remain in operation, after all the films have been allowed to enter into the housing, until all films have exited from the housing and have completed the processing cycle so as to ensure that no films remain in the housing 42.

It is specifically to be understood that the system as presently designed can accommodate more than one film in any single tank or in the drying area at a given time. The number of films in a given tank or in the drying area will depend upon the number of films which have been loaded in the magazine for processing and the manner in which they have been loaded, i.e., are they in contiguous slots or are they spaced intermittently, and the ratios of the number of teeth on the various meshed gears which are involved in driving the indexing system. FIG. 2 illustrates in schematic fashion the approximate displacement one from another of individual x-ray films where a completely filled magazine of films has been processed with each film slot in the magazine containing an x-ray film for processing, and with the gears in the system respectively having the relative numbers of teeth as shown in the drawings. However, it is to be clearly understood that should only a single film be ready to be processed, the system will adequately so process it, no matter which slot in the x-ray film holder the film to be processed is placed, so long as the operator places the index pin 90 under the indicia F, which is illustrated in FIG. 17, before initiating operation of the system. This will insure that the indexing means will allow a film in any slot 38 in the x-ray film holder 36, to be dropped into the processing apparatus to be processed therein. The number of films to be processed will vary depending upon the conditions which the dentist is attempting to diagnose, the age of the patient and consequent size of the jaw structure, and other variables.

As the dental x-ray films are passing through through the respective tanks of developer, fixer and rinse, the paddle means 74 will rotate since they are fixedly attached to some of the shafts to which the drive rollers are attached thus providing good mixing of the developing fluid, the fixing fluid and the rinse fluid. This is essential since the chemicals in the fluids may tend to separate out over a period of time.

Although the magazine dispenser shown in the drawings has been shown with 16 film positions, it is to be understood that any number of film positions can be provided in the x-ray film holder depending upon the size in which the magazine dispenser has been constructed. Likewise, it is to be understood that even through certain claims which are appended to this specification have contained therein dimensional limitations, the other, broader claims are applicable to any suitable dimensioned x-ray film processor and in fact the processor can be constructed in different sizes to accommodate various sizes of dental x-ray films. Furthermore, it will be understood that the description and specification of the present invention are intended to be illustrative rather than limiting and that the scope of the invention is to be determined from the appended claims.

What is claimed is:

1. In a system for developing a plurality of films including a housing with developer, fixer and rinse tanks and a drying area therein, said housing including a position means receiver disposed for complemental receipt of a position means of a film storage magazine, said housing having a film receipt slot in a top planar surface thereof, a plurality of pairs of tangentially contacting drive rollers within a film guide track formed between two halves of a guide track frame for guiding films from said film receipt slot successively into and out of said developer, fixer and rinse tanks and into said drying area, a roller drive motor, a gear train connecting an output shaft of said roller drive motor to a driven roller of each roller pair, said gear train including a plurality of worm gears mounted on a shaft rotatably connected to said output shaft of said roller drive motor, three tank gear drives corresponding to said three tanks each connected to one of said worm gears for driving pairs of rollers proximate said tanks, each tank gear drive including a drive gear meshed with one of said worm gears and a plurality of driven idler gears indirectly meshed in series with said drive gear for driving thereby, said pairs of rollers spaced along said film guide track so a leading edge of a film is between a next pair of rollers before a trailing edge has been released by a previous pair of rollers, the improvement comprising: a film storage magazine and a mechanism for sequentially dispensing films from said film storage magazine into said film receipt slot, said film storage magazine including:

a. an openable rectangular box having a sliding door at a first surface thereof, substantially light-tight when said sliding door is closed, a second surface of said box opposite said first surface disposed for contiquous contact with a top surface of said housing during dispensing of films from said magazine into said housing, said box including position means for complemental mating with said position means receiver, said box having first and second slots located in said second surface, said first slot for passage therethrough of film from a film holder within said box, said second slot for insertion therethrough of an index prong from said housing into engagement with teeth of a rack within said box and a third slot in a surface of said box parallel a direction of horizontal movement of said film holder and said rack within said box;

b. a film holder having a plurality of vertical film slots therethrough for receipt of single films, said film holder slideable horizontally within said box, c. a rack having teeth along a lower surface and having pin receiving vertical slots in a lateral surface;

d. pins extending from fixed positions on a lateral surface of said film holder into said vertical slots of said rack, for preventing horizontal rack movement with respect to said film holder while permitting vertical rack movement with respect to said film holder;

e. a slider attached to said film holder and extending through said third slot in said box, for hand movement of said holder and rack together horizontally within said box;

wherein said first slot is aligned with said film receipt slot for passage of films from said box into said housing when said magazine is positioned on said housing with said position means and said position means receiver in complemental engagement; and said mechanism for sequentially dispensing films from said film storage magazine into said film receipt slot including:

f. an index gear meshed with a gear of one of said tank gear drives for rotation therewith;

g. an index pin extending from a side surface of said index gear, remote from the axis of rotation thereof;

h. a horizontally moveable index tab slideably retained in said housing contacting said index pin as said index pin moves in a circular path, moveable horizontally upon such contact, tab movement for each complete rotation of said index gear being from an initial position to a second position and return, an extended planar portion of said tab forming a slideably moveable shutter door for opening and closing said film receipt slot, an upstanding portion of said tab forming said index prong extending out of said housing and protruding into said openable box through said second slot, having a beveled upper surface to engage any rack tooth which is in position for engagement when said magazine is positioned on said housing with said position means and said position means receiver in complemental engagement, whereby rotation of said index gear produces horizontal movement of said index tab and prong from an initial position to a second position and return, said movement resulting in opening and closing of said film receipt slot and, if said index prong is in engagement with said rack, advancement of said film holder and rack a distance by which contiguous film slots in said film holder are separated.

2. The system of claim 1 wherein said shutter door at said initial position of said tab closes said film receipt slot substantially light tight and at said second position opens said film receipt slot for passage therethrough of film from said magazine, and wherein said dispensing apparatus further includes:

a. an index spring resiliently connecting said index tab to said housing, for exerting force thereon thereby tending to maintain said index tab at said initial position.

3. In the system of claim 2 the further improvement wherein said film guide track includes:

a. a first film guide track portion formed by two opposed vertical side pieces of said halves of said quide track frame, each piece having a tapered groove therein, said two side pieces oriented with larger, open top portions of said grooves closer to one another than closed bottom portions of said grooves, said side pieces being laterally spaced a distance between bottom extremities of said grooves slightly greater than the width of a standard dental x-ray film, said tapered groove in each side piece having a flat bottom at the end of each side piece located closer to said film receipt slot in said housing, said taper reducing said flat bottom to a V-shape bottom at the ends of said side pieces remote from said film receipt slot, said side pieces forming a vertical path for films entering said housing from said magazine; and b. a second film guide track portion, connected to a lower end of said first film guide track portion for receiving films therefrom formed by two vertically disposed side pieces of said halves of said guide track frame, each side piece having a V-shaped groove therein, said side pieces being opposed whereby the open portions of said grooves face each other, said side pieces being spaced apart a distance between bottom extremities of said grooves only slightly greater than the width of a standard size dental x-ray film, said V-shaped grooves thereby forming a substantially continuously curved path for transport of films therealong from said first film guide track portion successively into and out of said developer, fixer and rinse tanks to a drying area.

4. In the system of claim 3, the further improvement comprising:

a. a motor mounted within said housing, for driving drying fan;

b. a drying fan; and c. a heater mounted within said drying area of said housing;

wherein said motor, said drying fan and said heater are within said drying area in such fashion that said drying fan blows air first across said heater and then against any films in said drying area.

5. In the system of claim 4, the further improvement wherein said V-shaped groove in said second film guide track portion and in that portion of said first film guide track portion having a V-shaped groove is formed at substantially a 30° angle.

6. In the system of claim 5, the further improvement wherein said path between said V-shaped grooves is one and five-sixteenths inches wide, plus or minus engineering tolerances, measured between bottoms of said V-shaped grooves.

* * * * *